US007537313B2

(12) United States Patent
Miyata

(10) Patent No.: US 7,537,313 B2
(45) Date of Patent: May 26, 2009

(54) LIQUID-JET HEAD AND LIQUID-JET APPARATUS

(75) Inventor: Yoshinao Miyata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 381 days.

(21) Appl. No.: 11/350,884

(22) Filed: Feb. 10, 2006

(65) Prior Publication Data

US 2006/0192817 A1 Aug. 31, 2006

(30) Foreign Application Priority Data

Feb. 14, 2005 (JP) ..... 2005-036910

(51) Int. Cl.
*B41J 2/14* (2006.01)
*B41J 2/045* (2006.01)

(52) U.S. Cl. ..... 347/50; 347/68

(58) Field of Classification Search ..... 347/50, 347/68–72

See application file for complete search history.

(56) References Cited

U.S. PATENT DOCUMENTS 5,016,023 A * 5/1991 Chan et al. ..... 347/42
2004/0001122 A1* 1/2004 Miyata ..... 347/68

FOREIGN PATENT DOCUMENTS

| | | | |
|---|---|---|---|
| JP | 2000-168084 A | | 6/2000 |
| JP | 2003-063000 | * | 3/2003 |
| JP | 2003-63000 A | | 3/2003 |
| JP | 2004-34293 A | | 2/2004 |

* cited by examiner

*Primary Examiner*—Stephen D Meier
*Assistant Examiner*—Geoffrey Mruk
(74) *Attorney, Agent, or Firm*—Sughrue Mion, PLLC

(57) ABSTRACT

The present invention includes a passage-forming substrate on which pressure generating chambers communicating with nozzle orifices ejecting a liquid are respectively formed separately from each other, and actuator devices each including a vibration plate provided on the passage-forming substrate, wherein, a protective plate is jointed to a side of the passage-forming substrate, the side facing the actuator devices, and driver circuits for driving the actuator devices are provided on the protective plate, and wherein each of the driver circuits is provided with individual terminals to which individual electrodes of the respective actuator devices are electrically connected, and connection terminals to which an external wiring line is directly connected, and each of the driver circuits is also provided with a common terminal electrically connected to a common electrode common to more than one of the actuator devices, and with a common connection terminal which is connected to the common terminal through a conductive wiring line and to which an external wiring line is directly connected.

5 Claims, 4 Drawing Sheets

LIQUID-JET HEAD AND LIQUID-JET APPARATUS

BACKGROUND OF THE INVENTION

1. Field of the Invention

The present invention relates to a liquid-jet head and a liquid-jet apparatus, and particularly relates to an ink-jet recording head and an ink-jet recording apparatus where a part of a pressure generating chamber communicating with a nozzle orifice for ejecting ink droplets is formed of a vibration plate, and droplets are ejected by driving an actuator device provided with the vibration plate.

2. Description of the Related Art

There has been an ink-jet recording head where a part of a pressure generating chamber communicating with a nozzle orifice for ejecting ink droplets is formed of a vibration plate ink, and where pressure is applied onto ink in a pressure generating chamber by driving an actuator device provided with the vibration plate, and whereby ink droplets are ejected through the nozzle orifice. In a case of using a piezoelectric element for an actuator device, each of the following two types has been in practical use. One type uses a piezoelectric actuator which operates in a lateral vibration mode whereby the piezoelectric actuator is elongated and contracted in an axial direction of piezoelectric elements. The other type uses a piezoelectric actuator which operates in a flexure-vibration mode. Additionally, as the one using a piezoelectric actuator which operates in the flexure-vibration mode, for example, there has been known one where a piezoelectric element is formed in a manner that a uniform piezoelectric material layer is formed all over the surface of a vibration plate thereof by using a deposition technique, and that, by use of a lithography method, this piezoelectric material layer is divided into parts each being in a shape corresponding to one pressure generating chamber in order that the respective parts can be independent from one another so as to correspond to the respective pressure generating chambers.

Additionally, there has been proposed a liquid-jet head where a protective plate provided with a driver IC is joined to the surface of a side of a passage-forming substrate, the side having piezoelectric elements, and where the driver IC on the protective plate and piezoelectric elements are electrically connected through wiring (for example, see Japanese Patent Laid-open Official Gazette No. 2004-34293, Pages 7 to 9, FIGS. 1 to 3). In this liquid-jet head, pads are provided to the driver IC and are electrically connected through bonding wires to the wiring lines drawn out from the respective piezoelectric elements.

However, because an external wiring line formed of a flexible print circuit (FPC) is connected to the protective plate, there has been a problem that, while wiring for connecting the external wiring and the driver IC is required on the protective plate, thus resulting in an cost increase, and that routing for the wiring is required, thus resulting in upsizing the head and a cost increase. In addition, there has been a problem that, if the external wiring is connected to the protective plate, a region for connecting the external wiring is required, and thus upsizing the head.

Additionally, there has been proposed one where, by previously connecting an external wiring line with a driver circuit, and by fixing the driver circuit on a joint plate provided to a side of a passage-forming substrate, the side having piezoelectric elements, lead electrodes drawn out from individual electrodes of the respective piezoelectric elements and the driver circuit are electrically connected to each other through bonding wires (for example, see Japanese Patent Laid-open Official Gazette No. 2003-63000, Page 5, FIGS. 1 and 2).

However, Japanese Patent Laid-open Official Gazette No. 2003-63000 provides the one which is obtained by previously mounting the driver circuit on the wiring line, and fixing the driver circuit on the joint plate, and which is nothing more than one where the driver circuit and the lead wiring line drawn out from the individual electrodes of the respective piezoelectric elements are electrically connected to each other through bonding wires. In Japanese Patent Laid-open Official Gazette No. 2003-63000, there is no mention on a common electrode common to a plurality of piezoelectric elements. Specifically, in general, because a relatively high voltage is applied to a common electrode common to a plurality of piezoelectric elements, electrical connection to the common electrode through a driver circuit from external wiring has not been practiced.

SUMMARY OF THE INVENTION

In consideration of the above described situations, an object of the present invention is to provide a liquid-jet head and a liquid-jet apparatus which realize size reduction of a head and cost reduction.

A first aspect of the present invention for solving the above problem is a liquid-jet head including: a passage-forming substrate on which pressure generating chambers each communicating with a nozzle orifice ejecting ink droplets are respectively formed separately from each other; and actuator devices each including a vibration plate provided on the passage-forming substrate. The liquid-jet head is characterized in that a protection substrate is joined to a side of the passage-forming substrate, the side facing the actuator devices, and driver circuits for driving the actuator devices are provided on the protection substrate, and that each of the driver circuits is provided with individual terminals to which individual electrodes of the respective actuator devices are electrically connected, and connection terminals to which an external wiring line is directly connected, and each of the driver circuits is also provided with a common terminal electrically connected to a common electrode common to more than one of the actuator devices, and a common connection terminal which is connected to the common terminal through a conductive wiring line and to which an external wiring line is directly connected.

In the first aspect, because wiring for electrically connecting the external wiring lines to the driver circuits becomes unnecessary on the protective plate. As a result, it becomes possible to downsize the head and to reduce a cost.

A second aspect of the present invention is the liquid-jet head in the first aspect, which is characterized in that the conductive wiring lines are provided on outer surfaces of the driver circuits.

In the second aspect, the conductive wiring lines can be formed in a wide width, and it becomes possible to prevent resistance of the conductive wiring lines from increasing, and to prevent the conductive wiring lines from generating heat and from breaking.

A third aspect of the present invention is the liquid-jet head in the first or second aspect, which is characterized in that the pressure generating chambers are provided in two lines on the passage-forming substrate, and the driver circuits are provided side by side in parallel in a manner that driver circuits correspond to the respective lines of pressure generating chambers, and that, on the passage-forming substrate, individual lead electrodes drawn out from the individual electrodes and common lead electrodes drawn out from the common electrodes are drawn out between adjacent ones of the driver circuits, the individual terminals and the common terminal of each one of the driver circuits are provided on a side thereof relatively close to another one of the driver circuits adjacent to the foregoing one, and the connection terminals and the common connection terminal of the foregoing one are provided on a side thereof opposite to the foregoing side.

In the third aspect, because wiring lines on the protective plate becomes unnecessary even when a plurality of driver circuits are provided on the protective plate, it becomes possible to realize size reduction of a head and cost reduction.

A fourth aspect of the present invention is a liquid-jet head in the third aspect, which is characterized in that the external wiring line is connected to the connection terminal and the common connection terminals, and an exposure hole for exposing the individual lead electrodes, the common lead electrode, the individual terminals and the common terminal is provided in the external wiring line.

In the fourth aspect, it becomes possible to electrically connect the driver circuit and the piezoelectric elements in regions exposed by the orifices. Thereby, connection wiring lines such as conductive wires connecting the driver circuit and the piezoelectric elements are prevented from making contact with external wiring lines, and hence it becomes possible to prevent a short circuit and breaking of the connection wiring lines.

A fifth aspect of the present invention is the liquid-jet head in the fourth aspect, which is characterized in that an external wiring line is connected in a manner straddling a plurality of driver circuits.

In the fifth aspect, a plurality of external wiring lines are not required, whereby it becomes easier to route an external wiring line around.

A sixth aspect of the present invention is a liquid-jet apparatus which is characterized by including the liquid-jet head in any one of the first to fifth aspects.

In the sixth aspect, it becomes possible to realize a downsized liquid-jet apparatus.

DESCRIPTION OF THE PREFERRED EMBODIMENTS

Hereinbelow, the present invention will be described in detail based on embodiments.

Embodiment 1

Figure 1:
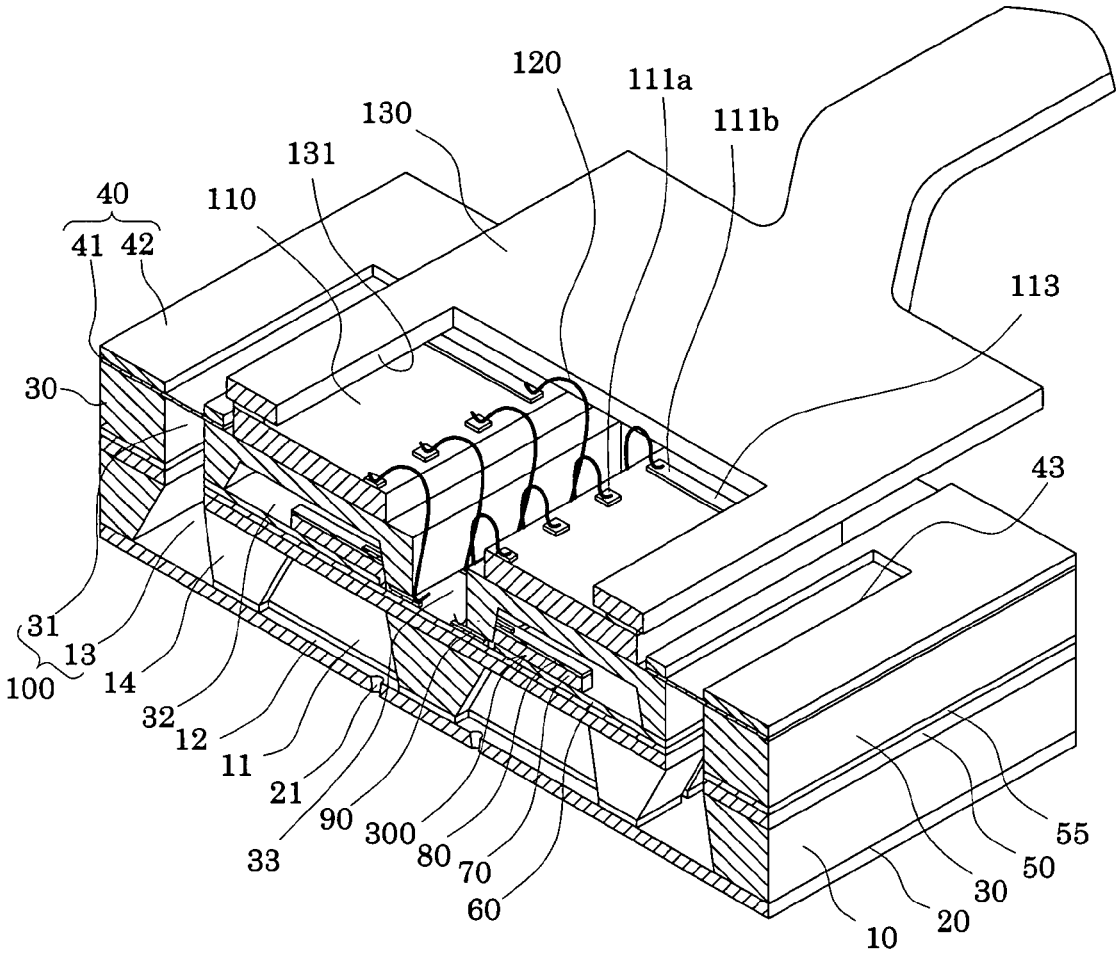
FIG. 1 is an exploded perspective view of an ink-jet recording head according to Embodiment 1 of the present invention.
Figure 2:
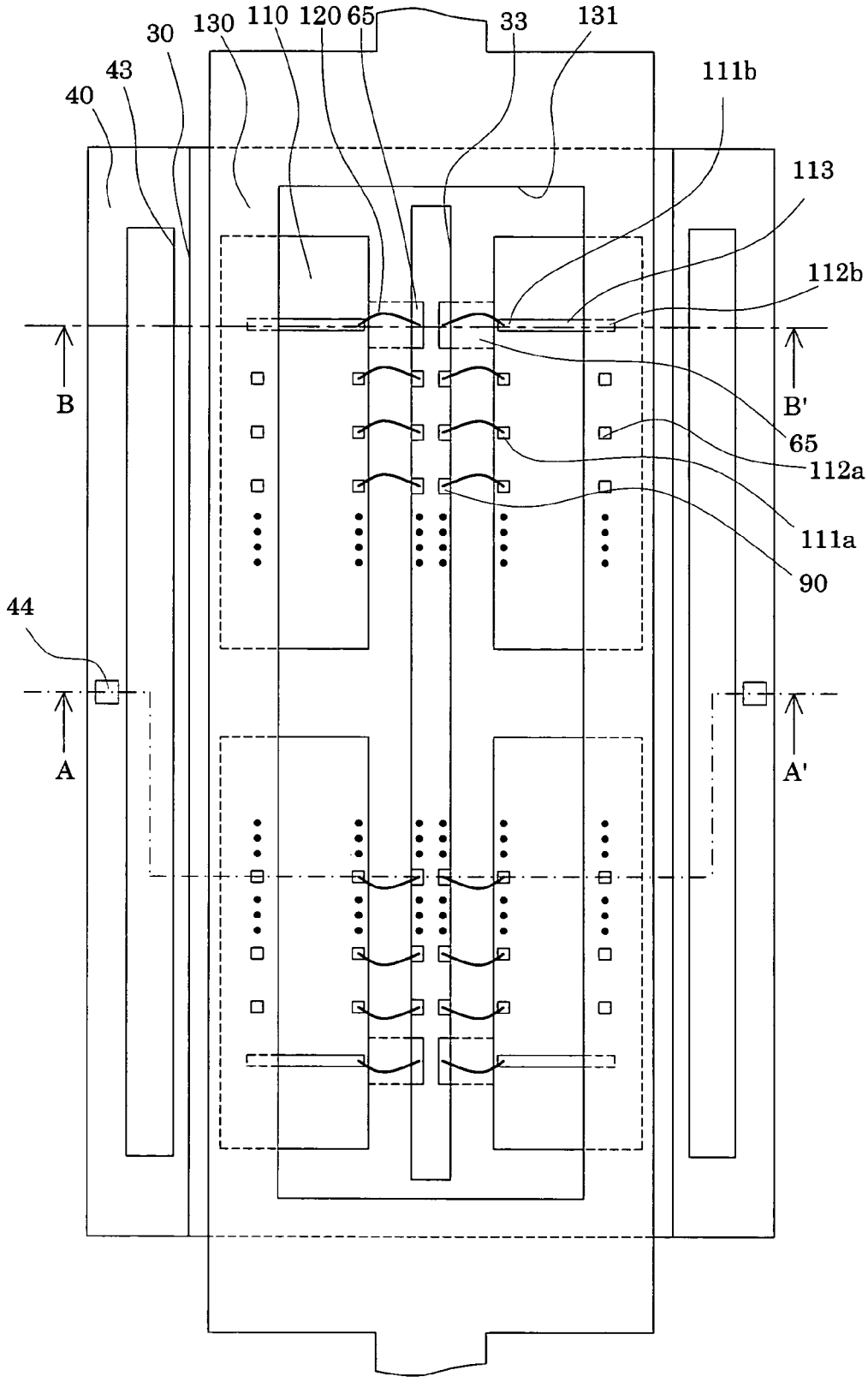
FIG. 2 is a plan view of the ink-jet recording head according to Embodiment 1 of the present invention.
Figure 3A:
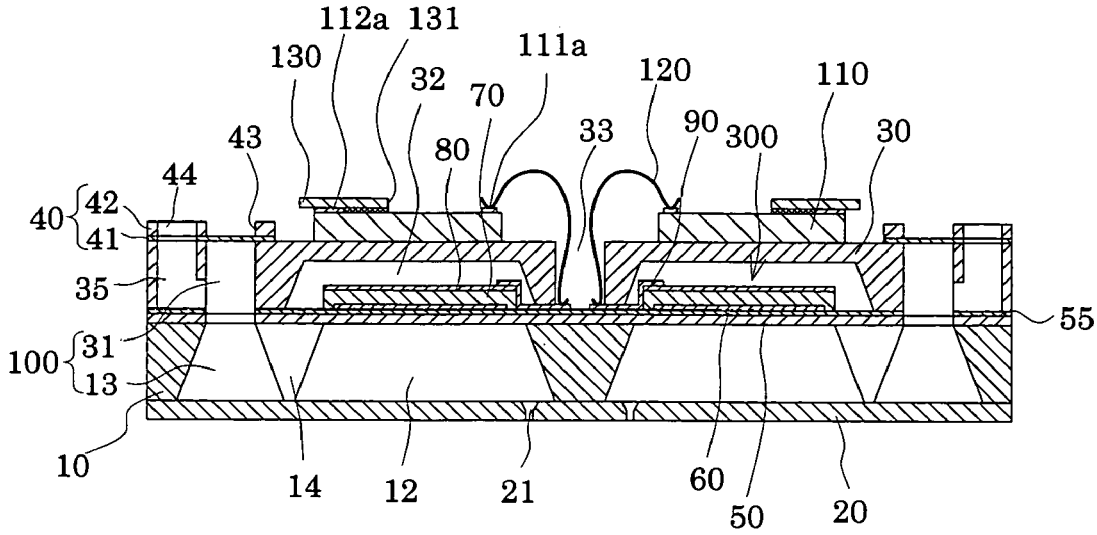
FIGS. 3A and 3B are cross-sectional views of the ink-jet recording head according to Embodiment 1 of the present invention.
Figure 3B:
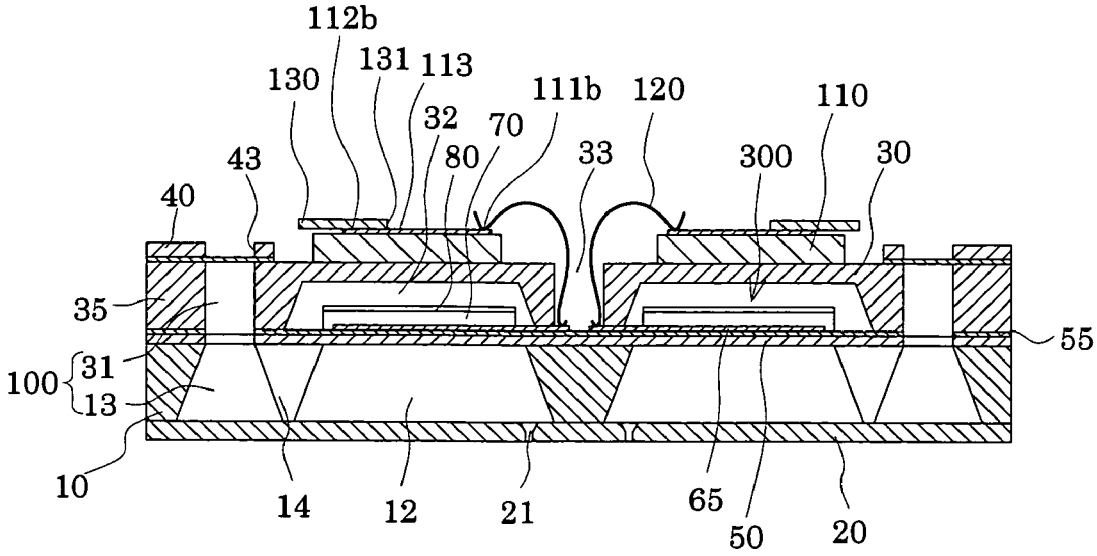

FIG. 1 is an exploded perspective view of ink-jet recording head according to Embodiment 1 of the present invention, FIG. 2 is a plan view of FIG. 1, and FIGS. 3A and 3B are cross-sectional views taken along a A-A' line and a B-B' line in FIG. 2 respectively.

As illustrated in the drawings in this embodiment, a passage-forming substrate 10 is formed of a single crystal silicon substrate of a plane direction (110), and on each of both surfaces thereof, an elastic film 50 is formed which is formed of silicon dioxide previously obtained through thermal oxidation, and which has a thickness between 0.5 to 2.0 μm.

On the passage-forming substrate 10, by applying anisotropic etching thereto from one surface, pressure generating chambers 12 divided by a plurality of partitions 11 are provided in two parallel lines side by side in a width direction thereof, and a communicating portion 13 is formed in a region outward from each of the pressure generating chambers 12 in a longitudinal direction thereof. The communicating portion 13 constitutes a part of a reservoir 100 intended to be a common ink chamber of the respective pressure generating chambers 12. The communicating portion 13 communicates, through an ink supply path 14, with one edge portion of each of the pressure generating chambers 12 in the longitudinal direction. The ink supply path 14 is formed in a width narrower than each of the pressure generating chambers 12, and keeps constant passage resistance of ink flowing from the communicating portion 13 into the pressure generating chamber 12.

Additionally, to an open-surface side of the passage-forming substrate 10, a nozzle plate 20 to which nozzle orifices 21, which communicates with the ink supply paths 14 respectively of the pressure generating chambers 12, are provided as through holes is joined with an adhesive agent or a thermally welding film. Note that, the nozzle plate 20 is formed of a piece of glass ceramic, stainless steel, or the like which has a thickness, for example, between 0.01 to 1 mm, and a coefficient of linear expansion, for example, between 2.5 to 4.5 ($\times 10^{-6}$/° C.) under a temperature not more than 300° C. The nozzle plate 20 covers all over one surface of the passage-forming substrate 10 with one surface thereof, and works as a reinforcement plate protecting the single crystal silicon substrate from shocks and external forces. Additionally, the nozzle plate 20 may be formed of a material which has a thermal expansion coefficient substantially equal to that of the passage-forming substrate 10. In that case, because thermal deformation methods of the nozzle plate 20 and the passage-forming substrate 10 become substantially equal, it becomes possible to easily join them by using a thermosetting adhesive agent.

On the other hand, on a side opposite to the open-surface side of the passage-forming substrate 10, the elastic film 50 is formed, the elastic film 50 being formed of silicon dioxide and having a thickness of, for example, about 1.0 μm. On the elastic film 50, an insulation film 55 is formed, the insulation film 55 being formed of zirconium oxide or the like and has a thickness of, for example, about 0.4 μm. Furthermore, on the insulation film 55, a lower electrode film 60, a piezoelectric layer 70, and an upper electrode film 80 are formed by a laminated method in a later described process, and thus, they form a piezoelectric element 300. The lower electrode film 60 is formed of a combination of platinum and iridium, or the like, and has a thickness of, for example, about 0.2 μm. The piezoelectric layer 70 is formed of lead zirconate titanate (PZT) or the like and has a thickness of, for example, about 1.0 μm. The upper electrode film 80 is formed of iridium or the like and has a thickness of, for example, about 0.05 μm. The piezoelectric element 300 mentioned here is a part including the lower electrode film 60, the piezoelectric layer 70 and the upper electrode film 80. In general, the piezoelectric element 300 is configured by using one of the electrodes thereof used as a common electrode, and by patterning the other one of the electrodes and the piezoelectric layer 70 in a manner corresponding to the respective pressure generating chambers 12. In this case, a part which is formed of any patterned one of the electrodes and the piezoelectric layer 70, and where piezoelectric flexure is generated due to voltage application to both of the electrodes, is referred to as a piezoelectric active part. In this embodiment, the lower electrode film 60 is provided as a common electrode of the piezoelectric element 300, and the upper electrode film 80 is provided as individual electrodes of the piezoelectric element 300. However, a configuration inverse to the above is used to suit the convenience of arrangements of driver circuits and wiring. As a result of any one of the above configurations, a piezoelectric active part is formed with respect to each of the pressure generating chambers 12. Additionally, here, an actuator device implies a device formed of the piezoelectric element 300 and a vibration plate which undergoes displacement by driving the piezoelectric element 300. Note that, in the above described example, the elastic film 50, the insulation film 55, and the lower electrode 60 operate as the vibration plate.

Here, as shown in FIG. 3A, to each part of the upper electrode film 80 provided as an individual electrode of the piezoelectric element 300, an individual lead electrode 90 formed of gold (Au) or the like is connected. The individual lead electrode 90 being drawn out from the vicinity of an edge portion opposite the ink supply path 14, and is provided in a manner extending to the insulation film 55 located in a region facing a gap between the lines of the pressure generating chambers 12.

On the other hand, the lower electrode film 60 as a common electrode of the piezoelectric element 300, is provided in a manner extending throughout a region facing one line of the pressure generating changers 12, and extends in a direction where the line of the pressure generating changers 12 extends. Additionally, to an edge portion of the lower electrode film 60, which is opposite to the ink supply path 14, common electrodes 65 drawn out from the lower electrode film 60 are provided in both ends of lines of the piezoelectric elements 300 in a direction where the lines extend in parallel to each other. Note that at least one common electrode 65 is necessary, and for example, a plurality of common electrodes 65 may be provided in a manner that one common electrode 65 is provided with respect to n pieces of piezoelectric elements 300.

In this embodiment, as shown in FIG. 3B, each of these common electrodes 65 is formed of the same layer which constitutes the lower electrode film 60, is drawn out from an edge portion of the lower electrode film 60, and is provided in a manner extending to reach the insulation film 55 located in a region facing a gap between the lines of pressure generating chambers 12. That is, these common electrodes 65 are provided so as to extend in the same direction as the individual lead electrodes 90.

Note that, in this embodiment, the piezoelectric elements 300 are provided in two lines in such a way that these lines face the respective lines of pressure generating chambers 12. Therefore, two pieces of lower electrode film 60 provided for the respective lines of the piezoelectric elements 300 are provided in order to be conducted to each other in each of the two sides of the lines in a direction where the lines extend in parallel.

Note that, in a case where a plurality of common electrodes 65 are provided in a manner where one common electrodes 65 is provided with respect ton pieces of piezoelectric elements 300, the common lead electrodes 65 provided so as to extend from each line of piezoelectric element 300 are connected to each other between the lines thereof, whereby the lower electrode film 60 of the piezoelectric elements 300 in each line is made to also conduct with the common lead electrode 65. Therefore, it becomes possible to prevent a voltage drop of the lower electrode film 60 provided as a common electrode, and thus it becomes possible to stably drive the piezoelectric elements 300.

On the passage-forming substrate 10 on which the piezoelectric elements as described above are formed, that is, on the lower electrode film 60, the insulation film 55 and the individual lead electrodes 90, a protective plate 30 is jointed thereto which includes reservoir portions 31 each constituting at least a part of the reservoir 100. These reservoir portions 31 are, in this embodiment, formed in a manner penetrating through the protective plate 30 in a thickness direction thereof, and arranged to the outsides of the lines of the pressure generating chambers 12. The reservoir portion 31 communicates with the connection portion 13 of the passage-forming substrate 10, and thus constitutes the reservoir 100 to be the common ink chamber of the respective pressure generating chambers 12, as described above.

On a region of the protective plate 30 facing to the piezoelectric element 300, there is provided a piezoelectric element holding portion 32 including a space which is not so small that it disturbs movements of the piezoelectric element 300. The protective plate 30 is only required to include a space not disturbing movements of the piezoelectric element 300, and it is irrelevant whether or not the space is tightly closed.

As the protective plate 30 described above, it is preferable to use a material having a thermal expansion coefficient substantially equal to that of the passage-forming substrate 10. The material includes, for example, glass, a ceramic material or the like. In this embodiment, the protective plate 30 is formed of the same material, which is a single crystal silicon substrate as the passage-forming substrate 10.

Additionally, in a substantially central portion of the protective plate 30, that is, in a region facing a gap between the lines of pressure generating chambers 12, a through hole 33 penetrating in a thickness direction of the protective plate 30. There, the vicinities of edges of the respective individual lead electrodes 90 drawn out from the respective piezoelectric elements 300, and parts of the respective common lead electrodes 65 are provided so as to be exposed inside the through hole 33.

On the protective plate 30, to both side of the through hole 33, that is, to a region corresponding to the respective lines of pressure generating chambers 12, four driver circuits 110 for driving each of the piezoelectric elements 300 arranged in two parallel lines are fixed. As the driver circuit 110, for example, a circuit board, a semiconductor integrated circuit (IC), or the like can be used.

On upper surfaces of the driver circuits 110 in the side thereof facing the through hole 33, a plurality of individual terminals 111*a* and a plurality of common terminals 111*b* are provided in lines arranged in parallel to each other. The individual terminals 111*a* are electrically connected directly to the respective lead electrodes 90 through connection wiring lines 120 each formed of a conductive wire such as a bonding wire. The individual terminals 111*b* are electrically connected directly to the respective common lead electrodes 65 through the connection wiring lines 120.

Additionally, on upper surfaces of the driver circuits 110 in the side thereof not facing the through hole 33, a plurality of connection terminals 112*a* are provided across the entire longitudinal direction of the driver circuits 110 in lines arranged in parallel to each other. An external wiring line 130 formed of a flexible print circuit (FPC) or the like is directly connected to the plurality of connection terminals 112*a*. To the connection terminals 112*a*, control signals or the like for driving the piezoelectric elements 300 are inputted through the external wiring line 130. Additionally, on upper surfaces of the driver circuits 110, in the side thereof not facing the through hole 33, common connection terminals 112*b* are formed which are connected to the common terminal 111*b* through conductive wiring lines 113, and to which the external wiring line 130 is directly connected. To the common connection terminals 112*b*, voltages for driving a plurality of the piezoelectric elements 300 are inputted through the external wiring line 130. Note that, although one common connection terminal 112*b* is provided to one edge of each of the driver circuits 110 in a longitudinal direction thereof, plural ones of the common connection terminals 112*b* may be provided to each of the driver circuits 110 in accordance with a number of the common lead electrodes 65 and positions thereof.

Furthermore, the conductive wiring lines 113 are provided onto top surfaces of the driver circuits 110, that is, onto outer surfaces thereof. By thus proving the conductive wiring lines 113 to the outside of the driver circuits 110 in this manner, it becomes possible to form the conductive wiring lines 113 in a wide width. As a result, while it becomes possible to surely prevent resistance of the conductive wiring lines 113 from increasing and thereby to prevent heat generation and breaking of the lines, it becomes possible to prevent breaking of the driver circuits 110. Note that, although the conductive wiring lines 113 are provided on the outer surfaces of the driver circuits 110 in this embodiment, the present invention is not limited to this case. For example, the conductive wiring lines 113 may be provided in insides of the driver circuits 110.

The external wiring line 130 is directly connected through an anisotropic conductive material (ACF) or the like, to the connection terminals 112*a* and the common connection terminals 112*b* which are all provided on the driver circuits 110. Additionally, to the external wiring line 130, an exposure hole 131 is provided in the external wiring line 130 in order that the through hole 33, and the individual terminals 111*a* and the common terminals 111*b* of the respective driver circuits 110 are exposed by the exposure hole. By this exposure hole 13, while the individual terminals 111*a*, the common terminals 111*b* and the through hole 33 are exposed, and the individual lead electrode 90 and the individual terminal 111*a* are allowed to be directly connected to each other through the connection wiring line 120, the common lead electrode 65 and the common terminal 111*b* are allowed to be directly connected to each other through the connection wiring line 120.

By thus connecting the external wiring lines 130 directly to the driver circuits 110, wiring for electrically connecting the external wiring lines 130 to the driver circuits 110 becomes unnecessary on the protective plate 30. As a result, it becomes possible to downsize the head and to reduce a cost. Moreover, a region for connecting the protective plate 30 to the external wiring line 130 becomes unnecessary on the protective plate 30, and thereby also, size reduction of the head is realized.

Additionally, because of the configuration where the individual terminals 111*a* and the common terminals 111*b* of the driver circuits 110 are electrically connected, respectively, directly to the individual lead electrodes 90 and the common lead electrodes 65, wiring for electrically connecting the driver circuits 110 and all of the electrodes of the piezoelectric elements 300 becomes also unnecessary on the protective plate 30. As a result, it becomes possible to downsize the head and to reduce a cost.

Moreover, on the protective plate 30 as described above, compliance plates 40 each constituted of a sealing film 41 and a fixing plate 42 are jointed. Here, the sealing film 41 is formed of a material (for example, a polyphenylene sulfide (PPS) film having a thickness of 6 μm) which is low in stiffness and has flexibility, and the sealing film 41 seals one side of the reservoir portions 31. On the other hand, the fixing plate 42 is formed of a hard material such as metal (for example, a piece of stainless steel (SUS) having a thickness of 30 μm). A region of this fixing plate 42 facing to the reservoir 100 is an open portion 43 from which the fixing plate 42 is completely removed in a thickness direction thereof, whereby the one side of the reservoir 100 is sealed only with the sealing film 41 having flexibility.

Additionally, in each of regions outward from a portion of this reservoir 100 substantially central in a longitudinal direction thereof, on the compliance plate 40, an ink inlet 44 for supplying ink to the reservoir 100 is formed. Furthermore, an ink inlet passage 35 allowing the ink inlet 44 and a sidewall of the reservoir 100 to communicate with each other is provided on the protective plate 30.

In the ink-jet recording head in this embodiment, ink droplets are ejected in the following manner. Ink is taken in from the ink inlet 44 connected to external ink supply means not illustrated, and the inside of components from the reservoir 100 to the nozzle orifice 21 is filled with ink. Afterwards, in accordance with a signal from the driver circuit, a voltage is applied between the lower electrodes and the upper electrodes respectively corresponding to the pressure generating chambers 12. Thereby, the elastic film 50, the insulation film 55, the lower electrode film 60 and the piezoelectric element body layer 70 is caused to undergo-flexure deformation. As a result, pressure inside each of the pressure generating chambers 12 is increased, and thereby ink droplets are ejected through the nozzle orifice 21.

Other Embodiments

Although Embodiment 1 of the present invention has been described hereinabove, a basic configuration of the ink-jet recording head is not limited to the one described as above. For example, although the common lead electrodes 65 in Embodiment 1 described above are formed of the same layer as the lower electrode film 60 is constituted of, a configuration thereof is not limited to this. For example, the common lead electrodes 65 may be formed of the same layer as the individual lead electrode 90. It is needless to say that the common lead electrodes 60 may be provided separately from the lower electrode film 60 and the individual lead electrode 90.

Additionally, although the component obtained by forming the piezoelectric elements 300 on the vibration plate is given in Embodiment 1 described above as an example of an actuator device provided with a vibration plate, the present invention is also applicable to an actuator device which generates static electricity between a common electrode of a vibration plate and an individual electrode formed with a predetermined space interposed therebetween, and ejects ink droplets from the nozzle orifice by causing the vibration plate to undergo deformation depending on whether the static electricity is generated.

Furthermore, although a thin-film type ink-jet recording head produced with application of deposition and lithographic techniques is given as an example in Example 1 described above, it is needless to say that the present invention is not limited to this. For example, the present invention is also adoptable in a thick-film type ink-jet recording head formed by a method where a green sheet is attached.

Figure 4:
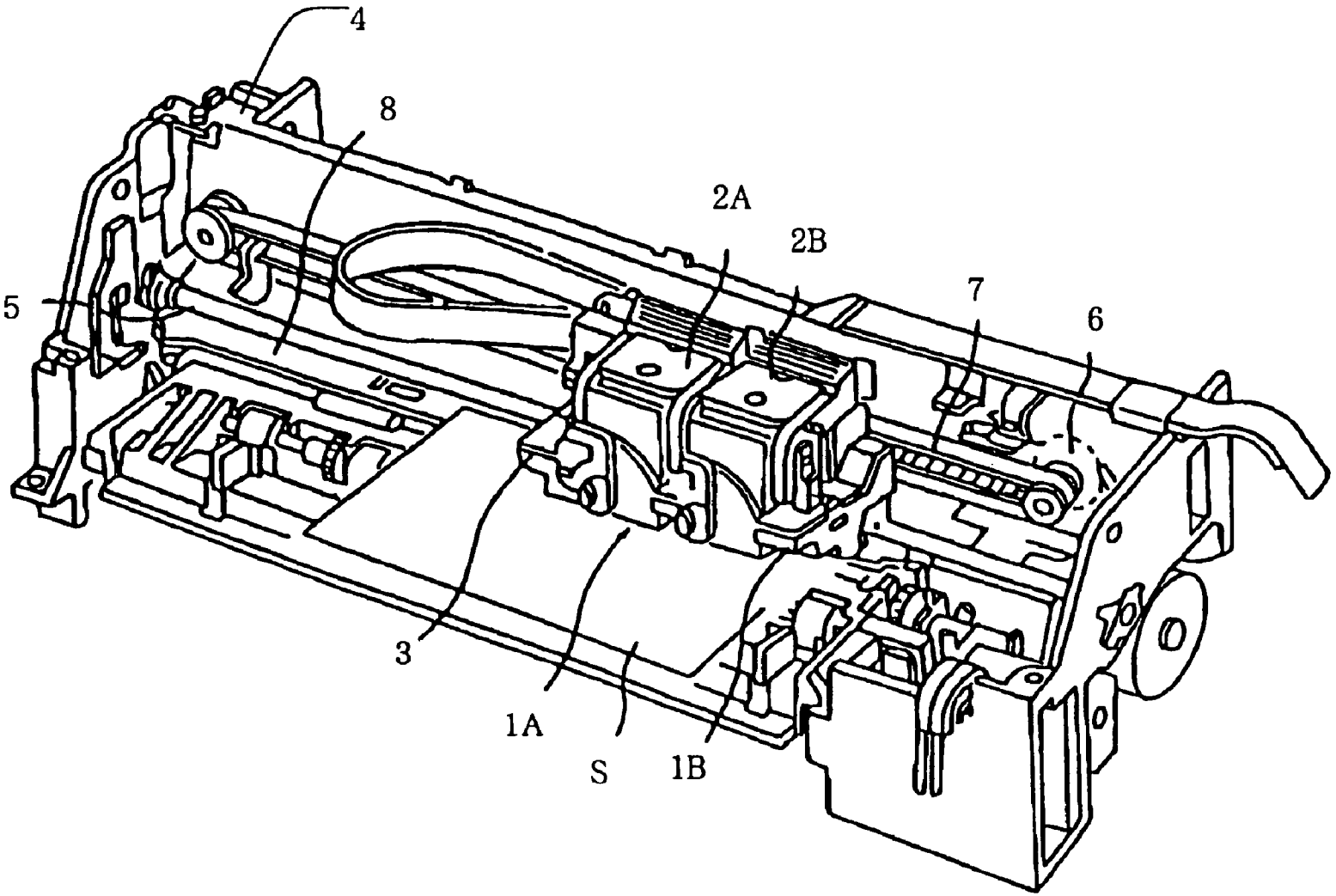
FIG. 4 is a schematic view of an ink-jet recording apparatus according to one embodiment.

Additionally, each of the ink-jet recording heads in the above described embodiments constitutes a part of a recording head unit including an ink passage communicating with an ink cartridge and the like, and is mounted on an ink-jet recording apparatus. FIG. 4 is a schematic view of an example of the ink-jet recording apparatus.

As shown in FIG. 4, in a recording head unit 1A and a recording head unit 1B which each include an ink-jet recording head, a cartridge 2A and a cartridge 2B constituting ink supply means are provided in a freely attachable and detachable manner. A carriage 3 having the recording head units 1A and 1B mounted thereon is provided in a freely movable manner in which the carriage 3 can move in an axial direction of a carriage axis 5 fixed to a device body 4. The recording head units 1A and 1B are configured to eject a black-ink composition and a color-ink composition, respectively.

Furthermore, driving force of a driving motor 6 is transferred to the carriage 3 through a plurality of gears not illustrated and a timing belt 7, whereby the carriage 3 having the recording head units 1A and 1B mounted thereon is allowed to move along the carriage axis 5. On the other hand, in the device body 4, a platen 8 is provided along the carriage axis 5, and a recording sheet S, which is fed by a feeding roller not illustrated and is a recording medium such as a sheet of paper, is allowed to be conveyed on the platen 8.

Note that, although an ink-jet recording head is given as an example of the liquid-jet head in Embodiment 1 described above, the present invention is broadly aimed at liquid-jet heads in general. Therefore, it is needless to say that the present invention is also applicable to liquid-jet heads which inject liquid other than ink. As other liquid-jet heads, there can be cited, for example: various kinds of recording heads used in image recording apparatuses such as a printer, a coloring material jet head used for producing color filters for liquid crystal displays; electrode material jet head used for forming electrodes for organic EL displays, FEDs (shield emitting displays) or the like; and a bio-organic material jet head used for producing color filters for bio-chips.

What is claimed is:

1. A liquid-jet head comprising:

a passage-forming substrate on which pressure generating chambers communicating with a nozzle orifice ejecting liquids are respectively formed separately from each other; and actuator devices each including a vibration plate provided on the passage-forming substrate, wherein a protection substrate is joined to a side of the passage-forming substrate, the side facing the actuator devices, and driver circuits for driving the actuator devices are provided on the protection substrate, wherein each of the driver circuits is provided with individual terminals to which individual electrodes of the respective actuator devices are electrically connected, and connection terminals to which an external wiring line formed of a flexible print circuit is directly connected through an anisotropic conductive material, and the each of the driver circuits is also provided with a common terminal electrically connected to a common electrode common to more than one of the actuator devices, and a common connection terminal which is connected to the common terminal through a conductive wiring line and to which an external wiring line is directly connected through an anisotropic conductive material, wherein the conductive wiring line is connected to the common terminal and the common connection terminal, wherein the conductive wiring line is provided on an outer surface of the each of the driver circuits, and wherein the external wiring line and the common terminal are connected without passing an inside of the each of the driver circuits.

2. The liquid-jet head according to claim 1, wherein the pressure generating chambers are provided in two lines on the passage-forming substrate, and the driver circuits are provided side by side in parallel in a manner that the driver circuits correspond to the respective lines of the pressure generating chambers, and wherein, on the passage-forming substrate, individual lead electrodes drawn out from the individual electrodes and common lead electrodes drawn out from the common electrode are drawn out between adjacent ones of the driver circuits, the individual terminals and the common terminal of the each of the driver circuits are provided on a first side thereof relatively close to another one of the driver circuits adjacent to the each of the driver circuits, and the connection terminals and the common connection terminal of the each of the driver circuits are provided on a second side thereof opposite to the first side.

3. The liquid-jet head according to claim 2, wherein the external wiring line is connected to the connection terminal and the common connection terminals, and an exposure hole for exposing the individual lead electrodes, the common lead electrode, the individual terminals and the common terminal is provided in the external wiring line.

4. The liquid-jet head according to claim 3, wherein the external wiring line is connected in a manner straddling the driver circuits.

5. A liquid-jet apparatus comprising the liquid-jet head according to claim 1.

* * * * *